US008474185B2

(12) United States Patent
Busch

(10) Patent No.: US 8,474,185 B2
(45) Date of Patent: Jul. 2, 2013

(54) SLIDING DOOR SUSPENSION WITH INTEGRAL LINEAR DRIVE SYSTEM

(75) Inventor: Sven Busch, Dortmund (DE)

(73) Assignee: Dorma GmbH + Co. KG, Ennepetal (DE)

( * ) Notice: Subject to any disclaimer, the term of this patent is extended or adjusted under 35 U.S.C. 154(b) by 215 days.

(21) Appl. No.: 12/668,621

(22) PCT Filed: Jul. 8, 2008

(86) PCT No.: PCT/EP2008/005534
§ 371 (c)(1),
(2), (4) Date: Jan. 11, 2010

(87) PCT Pub. No.: WO2009/007086
PCT Pub. Date: Jan. 15, 2009

(65) Prior Publication Data

US 2010/0269415 A1 Oct. 28, 2010

(30) Foreign Application Priority Data

Jul. 10, 2007 (DE) ..... 10 2007 032 474

(51) Int. Cl.
*E05F 11/00* (2006.01)

(52) U.S. Cl.
USPC ..... 49/358; 49/360

(58) Field of Classification Search
USPC ..... 49/358, 360
See application file for complete search history.

(56) References Cited

U.S. PATENT DOCUMENTS 1,986,616 A * 1/1935 Baldwin ..... 310/13
2,337,430 A * 12/1943 Panfilo Trombetta ..... 310/13
3,442,051 A * 5/1969 Johnson et al. ..... 49/414
4,641,065 A * 2/1987 Shibuki et al. ..... 318/135
5,134,324 A * 7/1992 Sakagami et al. ..... 310/12.04
5,172,518 A * 12/1992 Yoshino ..... 49/360
5,712,516 A * 1/1998 Kabout ..... 310/12.04
5,852,897 A * 12/1998 Sukale ..... 49/358
6,449,905 B2 * 9/2002 Maki ..... 49/360
6,469,406 B1 * 10/2002 Hwang et al. ..... 310/12.29

(Continued)

FOREIGN PATENT DOCUMENTS

EP 142039 A2 * 5/1985
GB 2097855 A * 11/1982

(Continued)

*Primary Examiner* — Jerry Redman
(74) *Attorney, Agent, or Firm* — Cozen O'Connor

(57) ABSTRACT

A suspension for at least one panel, which is movable along a travel path, is has a guiding profile configured to longitudinally extend along the travel path and to have sidewall sections. The sidewall sections are configured to extend in a direction of the longitudinal extension of the guiding profile and parallel to a vertical extension of the movable panel. In addition, at an end facing away from the movable panel, the sidewall sections are connected to each other by means of a horizontal wall section. At an end facing the guiding profile, the at least one movable panel is received in a guided and supported manner in the guiding profile. A driver member of a linear drive system is operatively connected to the movable panel. In the guiding profile, in a space between the horizontal wall section and the driver member, a reception space is formed, into which a driving profile is fitted and stationarily mounted to the guiding profile, the linear drive system, at least partially, being accommodated in the driving profile and the driving profile being disposed in the guiding profile above a guide of the movable panel.

16 Claims, 15 Drawing Sheets

U.S. PATENT DOCUMENTS

Figure 1:
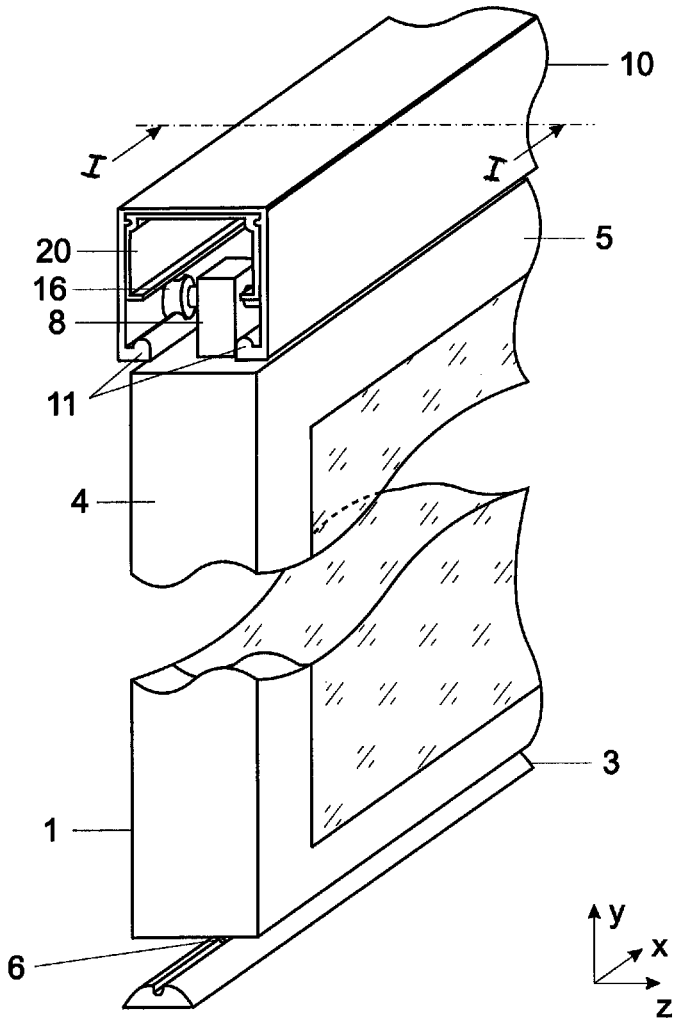

| | | | | |
|---|---|---|---|---|
| 6,543,581 | B1 * | 4/2003 | Durand et al. | 187/316 |
| 6,581,332 | B1 * | 6/2003 | Kim | 49/358 |
| 7,013,605 | B2 * | 3/2006 | Zhou et al. | 52/30 |
| 7,246,688 | B2 * | 7/2007 | Tonna et al. | 187/324 |
| 7,504,788 | B2 * | 3/2009 | Haab et al. | 318/286 |
| 7,578,096 | B2 * | 8/2009 | Haab et al. | 49/409 |
| 7,592,720 | B2 * | 9/2009 | Busch | 310/12.24 |
| 7,608,949 | B2 * | 10/2009 | Busch | 310/14 |
| 8,033,068 | B2 * | 10/2011 | Luttmann et al. | 52/243.1 |
| 2005/0172563 | A1 * | 8/2005 | Komoda | 49/358 |
| 2005/0274078 | A1 | 12/2005 | Gilchrist | |
| 2008/0100152 | A1 * | 5/2008 | Busch | 310/14 |
| 2008/0209813 | A1 * | 9/2008 | Haab et al. | 49/360 |
| 2009/0045760 | A1 * | 2/2009 | Busch | 318/135 |
| 2010/0139037 | A1 * | 6/2010 | Hufen et al. | 16/88 |
| 2010/0139172 | A1 * | 6/2010 | Busch | 49/360 |

FOREIGN PATENT DOCUMENTS

| | | | |
|---|---|---|---|
| JP | 06101379 | A * | 4/1994 |
| JP | H 10-505737 | | 6/1998 |
| JP | 11-131892 | | 5/1999 |
| JP | 2002-322863 | | 11/2002 |
| WO | WO 94/13055 | | 6/1994 |
| WO | WO 9413055 | | 6/1994 |
| WO | WO 9742389 | | 11/1997 |
| WO | WO 2006074784 | | 7/2006 |

* cited by examiner 20
22
23
24
25
51
52
52t
53
54
55
56
57
58
59
50
51a
51b
23s
D
III
x
y
z 20
25
60
61
62
63
64
64s
65
61t
61b
63'
63"
63t
63b
63t'
63b'
63s
63h
63, 63'
x
y
z 20
5
45
70
25
22
30
40
43
47a
47
41
35
34
33
26
46
2
$h_A$
$h_S$
x
y
z 5
5a
44
48
1
20
70
43
43p
43r

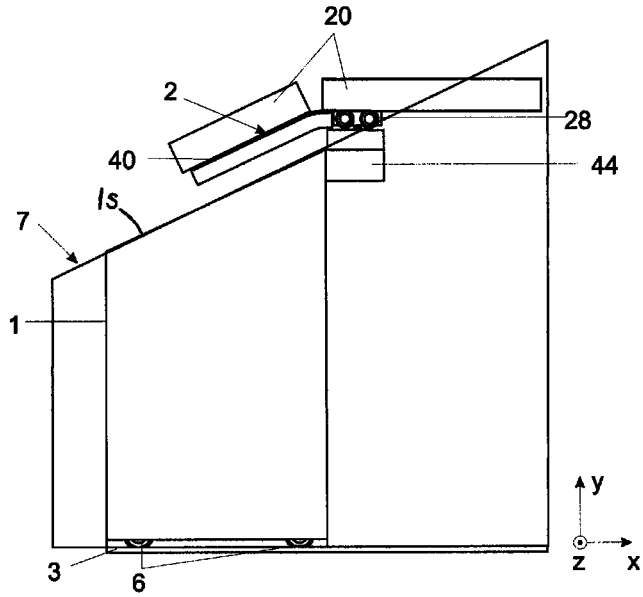
Fig. 6A
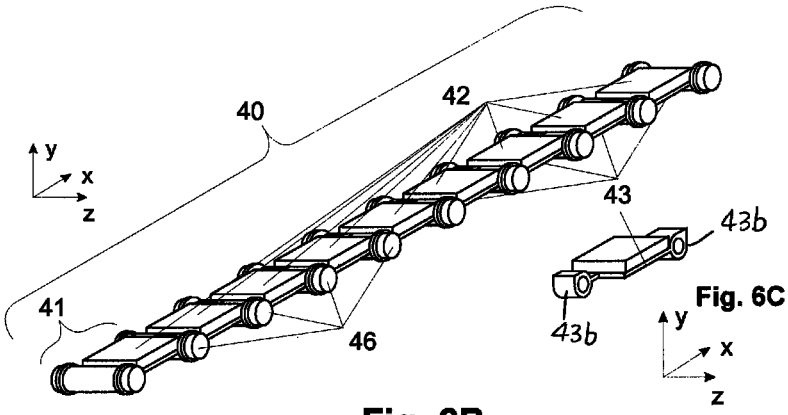
Fig. 6C
Fig. 6B

SLIDING DOOR SUSPENSION WITH INTEGRAL LINEAR DRIVE SYSTEM

CROSS REFERENCE TO RELATED APPLICATIONS

This is a U.S. national stage of application No. PCT/EP2008/005534, filed on Jul. 8, 2008.Priority is claimed on German Application No.: 10 2007 032 474.1 filed Jul. 10, 2007, the content of which is incorporated here by reference.

FIELD OF THE INVENTION

The invention relates to a sliding door with an integral linear drive system, in particular with a linear motor.

BACKGROUND OF THE INVENTION

Sliding doors are very well known. If sliding doors are to be provided with a linear drive system, the challenge is having to modify already existing suspensions as little as possible or not at all.

SUMMARY OF THE INVENTION

Therefore, an object of the invention is to provide a solution to the above mentioned problem.

An inventive suspension for at least one panel, in particular a sliding door leaf, movable along a travel path, has a guiding profile, which is configured such as to extend longitudinally along a travel path of the at least one movable panel, and has sidewall sections. The sidewall sections are configured to extend in a direction of the longitudinal extension of the guiding profile and parallel to a vertical extension of the movable panel. In addition, at an end facing away from the at least one movable panel, the sidewall sections are connected to each other by means of a horizontal wall section. At an end facing the guiding profile, the at least one movable panel is received in a guided and supported manner in the guiding profile. A driver member of the linear drive system is operatively connected to the at least one movable panel such that, during a movement, the driver member entrains the at least one movable panel. In the guiding profile, in a space between the horizontal wall section and the driver member, a reception space is formed into which a driving profile is fitted and stationarily mounted to the guiding profile, the linear drive system, at least partially, being accommodated in the driving profile and the driving profile being disposed in the guiding profile above a guide of the movable panel. It is thereby possible to provide the movable panel with a linear drive system while using an already existing guiding profile without having to machine the guiding profile. Therefore, the possibility of retrofitting to another linear drive system or even of re-establishing a manually operated installation is given.

The linear drive system may be formed by means of a flexible drive. The flexible drive has at least one traction means, for example in the shape of a rope. The traction means is guided revolving around two deflection pulleys, respectively one of the two deflection pulleys being disposed freely rotatably at the driving profile in a terminal area of the travel path. A drive motor is operatively connected to one of the two deflection pulleys or to a driving wheel of the flexible drive, which driving wheel is in a driving operative connection with the traction means. In this case, one end of the driver member, facing away from the at least one movable panel, is attached to the traction means. The deflection pulleys are preferably supported on axles, which in turn, at both ends, are supported against sidewall sections of the driving profile. Thereby, a compact linear drive system is built and formed as a module. The traction means can be formed by means of a traction rope, a toothed belt or a chain.

The linear drive system may be formed as well by means of a spindle drive. A drive motor is operatively connected to a threaded spindle. The threaded spindle is freely rotatably supported in spindle bearings and disposed to extend in the direction of the travel path. The spindle bearings are attached to the driving profile or are integrally formed with it. At an end facing away from the movable panel, the driver member has a threaded bush section. The threaded bush section has a threaded section, which is configured complementarily to the threaded spindle and is screwed onto the threaded spindle by means of this threaded section. Preferably, the driver member has a roller, which is disposed such as to roll along a travel path of the movable panel, on a side of the horizontal wall section facing it, and to be supported on the side facing it. Thereby, the threaded spindle is prevented from bending in the direction of the horizontal wall section.

As an alternative, the linear drive system may be formed by means of a linear motor. The driver member is preferably formed by means of a body of a rotor member. A stator of the linear motor is attached to a mounting member and extends over a predetermined area of the travel path along this area. At a side facing away from the movable panel, the rotor has a row of magnets. The rotor and the stator are interacting in such a way that energizing the stator effects a movement of the rotor, the body being operatively connected to the movable panel at a side facing the movable panel.

The plurality of possible linear drive systems having the above mentioned advantages provide the freedom of choosing the linear drive system depending on certain advantages and of not being limited to one particular linear drive system.

The movable panel may consist of a sliding door leaf, of a curved sliding door leaf, of a revolving door leaf, of a folding door leaf or even of a partitioning wall module.

Furthermore according to the invention, it is intended that the guiding profile has several reception spaces, which are disposed side by side transversally to a direction of movement of the at least one movable panel and are essentially aligned parallel to each other. It is thereby possible to use several sliding doors with their own linear drive system respectively, while utilizing the existing guiding profile.

Figure 2A:
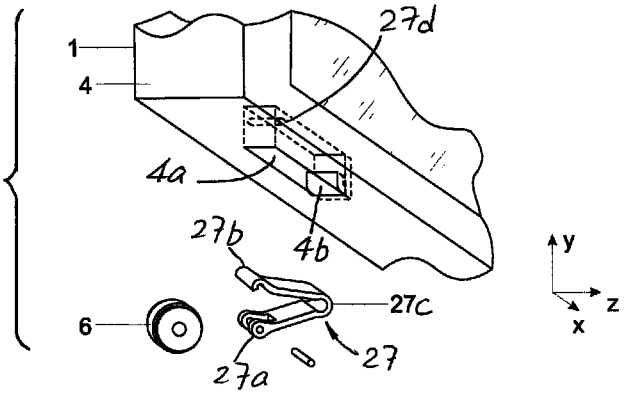
Figure 2B:
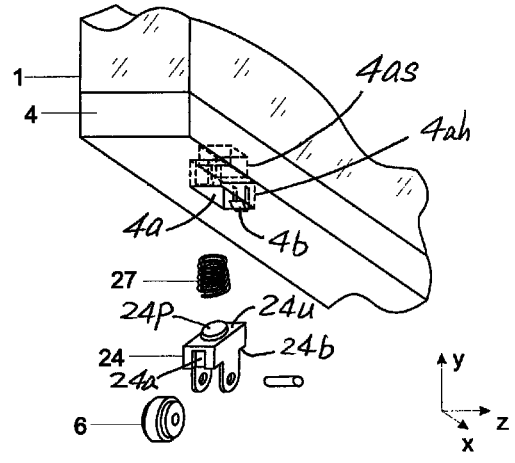
Figures 3A, 3B, 3C:
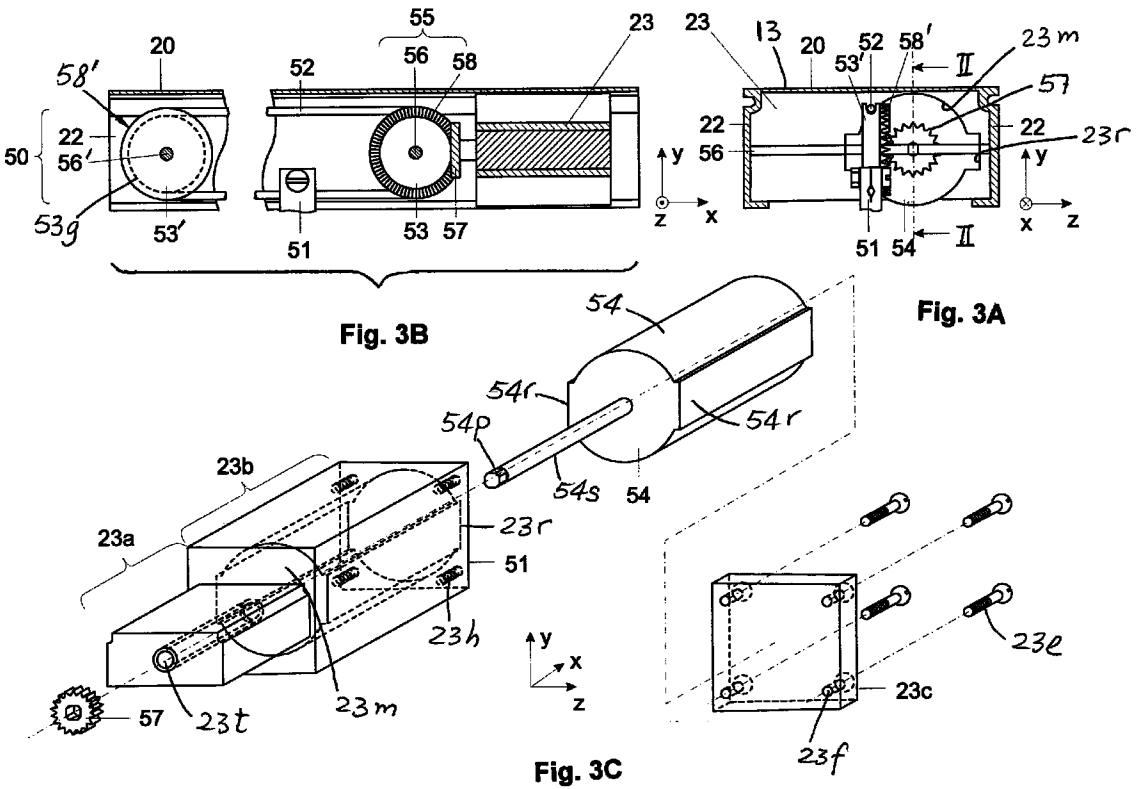
Figure 3D:
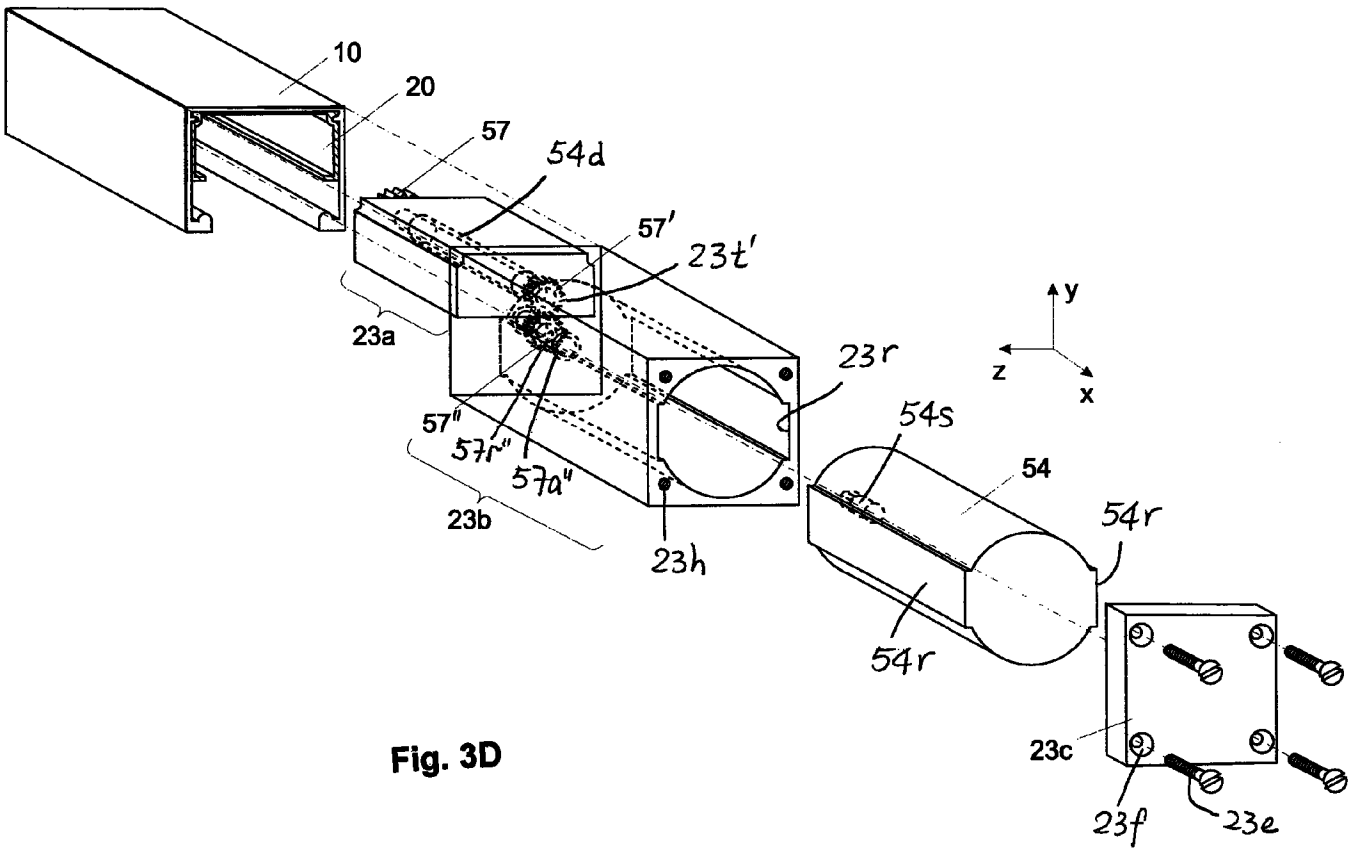
Figures 3E, 3F, 3G, 3H, 3I, 3J:
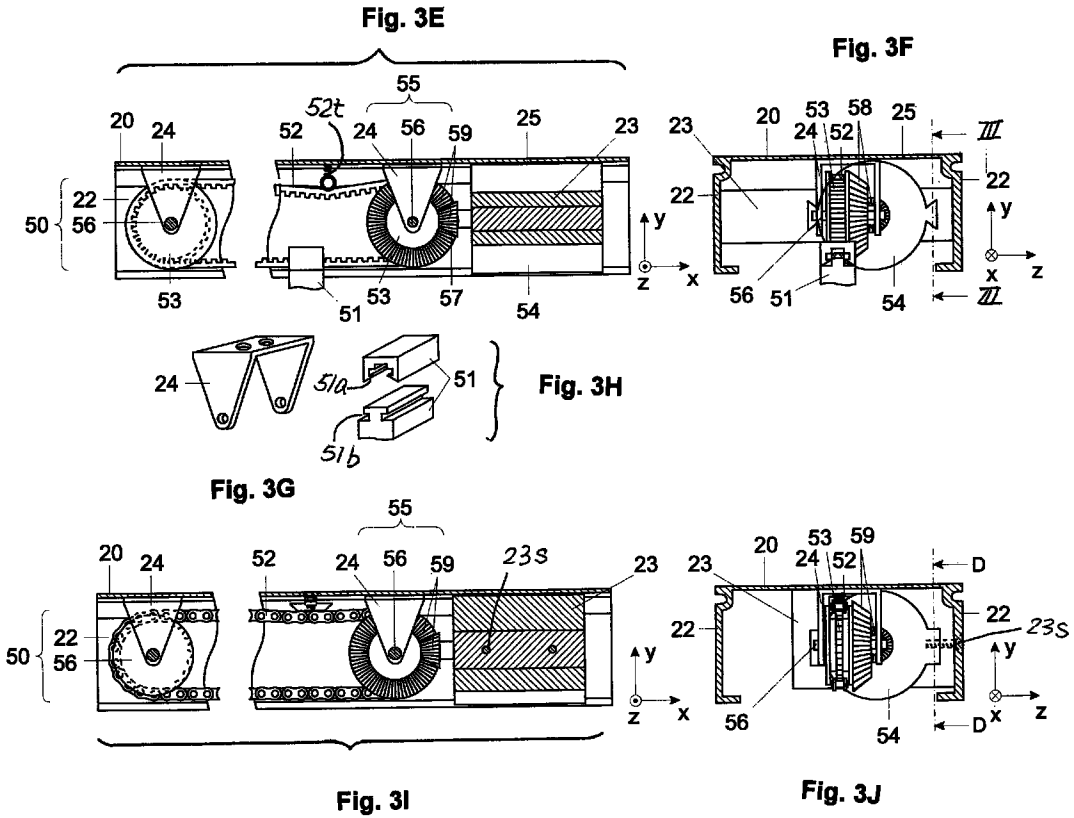
Figures 4A, 4B, 4C, 4D, 4E, 4F, 4G, 4H, 4I:
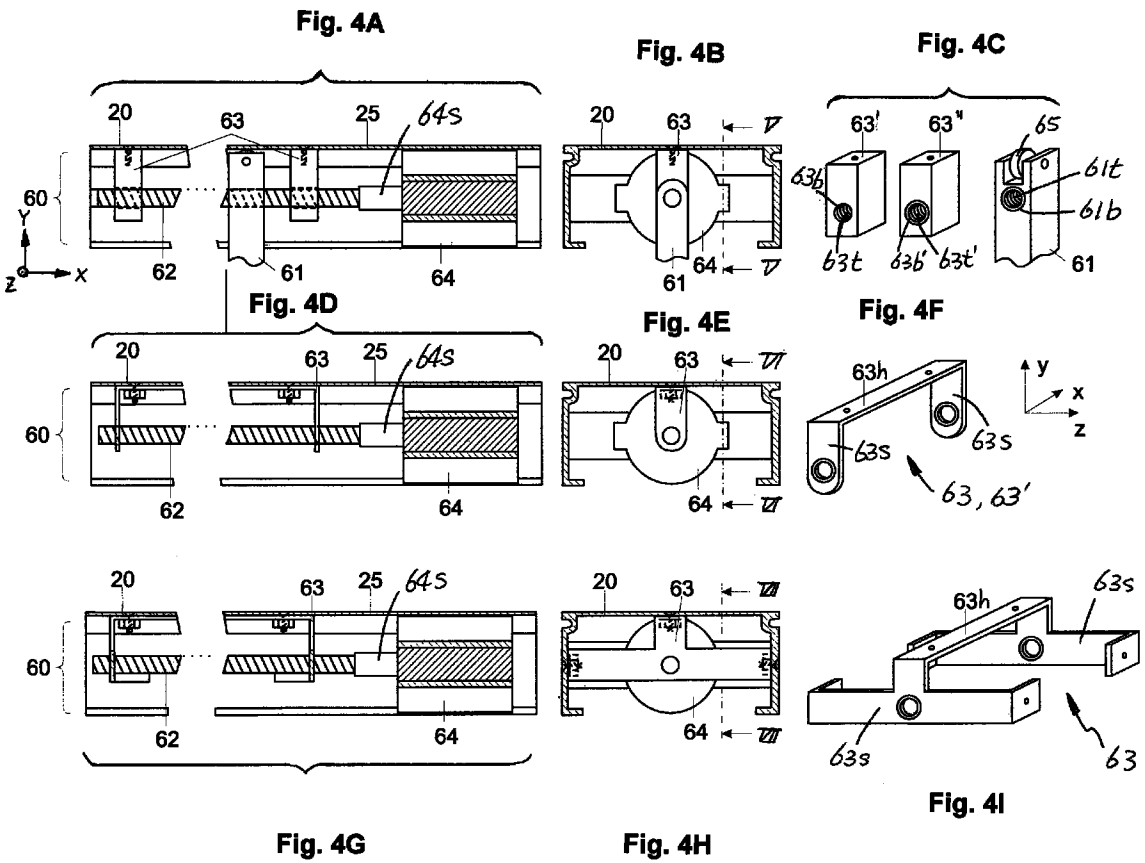
Figures 5A, 5B, 5C, 5D:
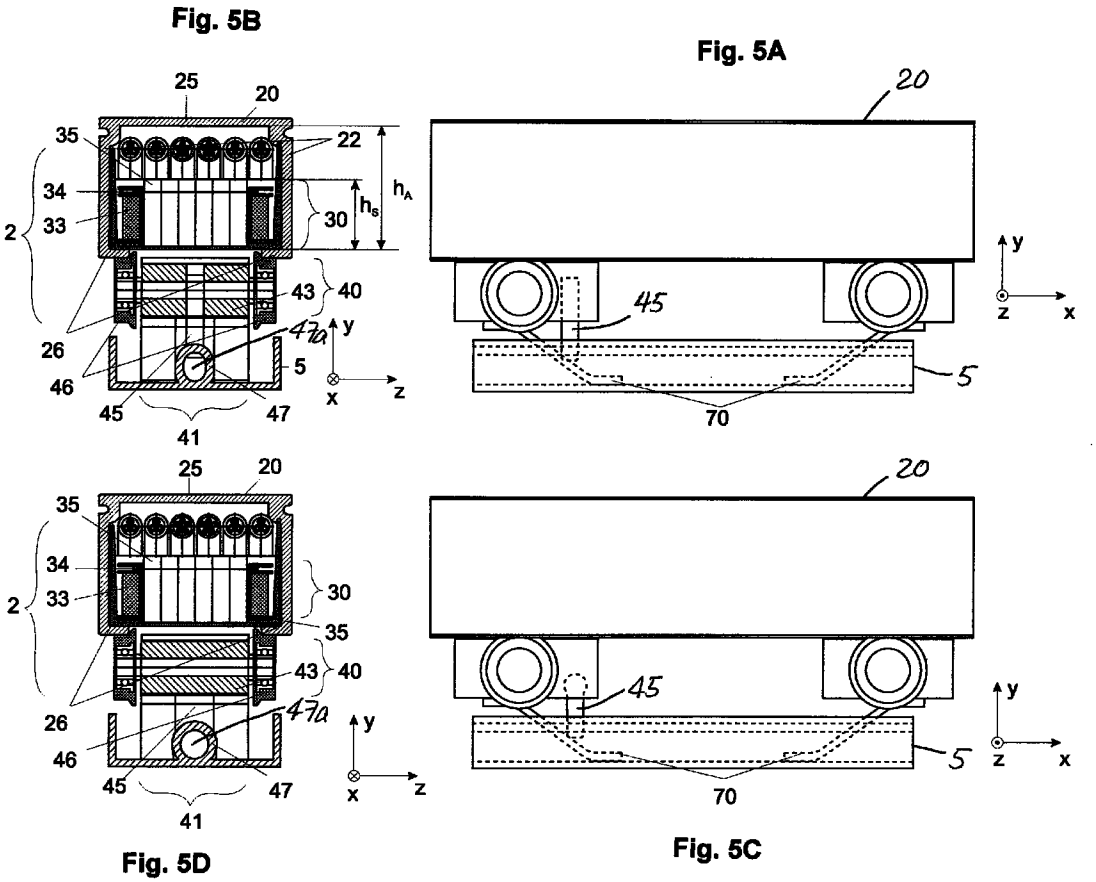
Figures 5E, 5F, 5G, 5H, 5I, 5J, 5K:
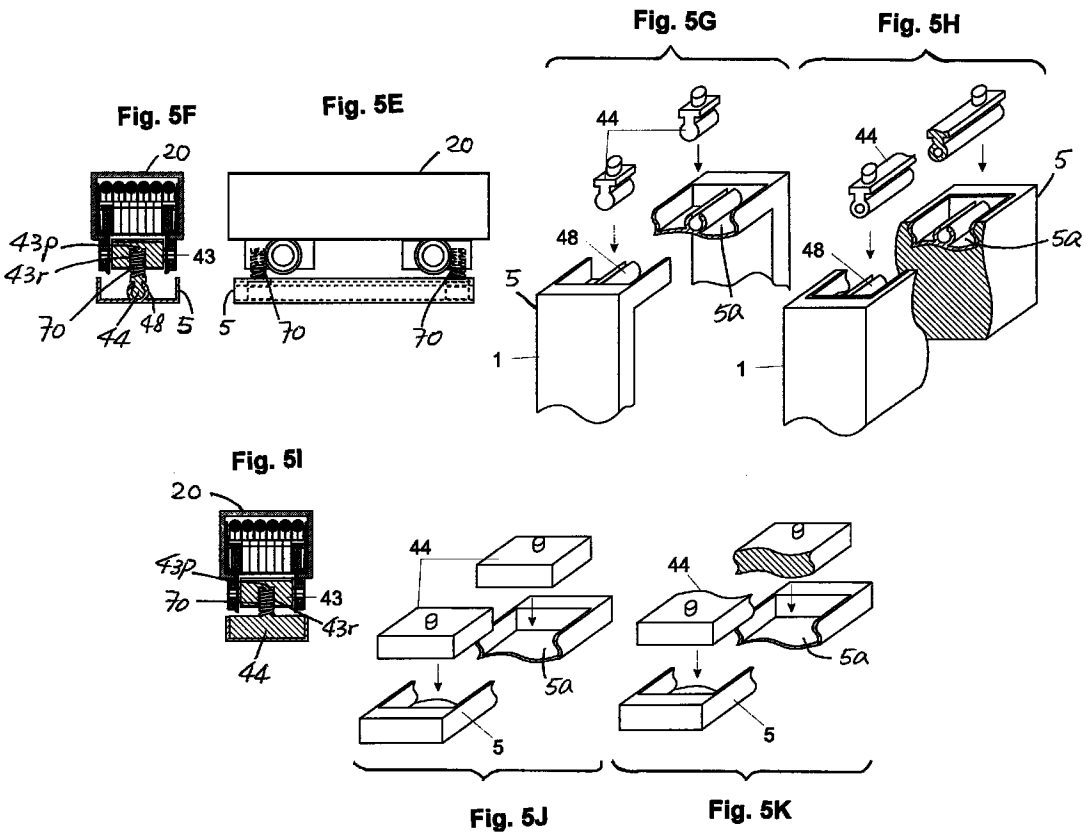
Figure 5L:
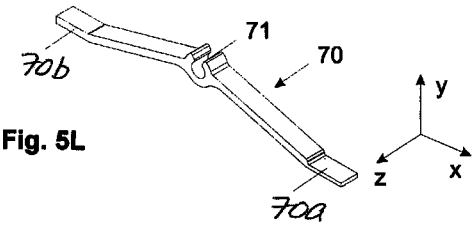
Figure 5M:
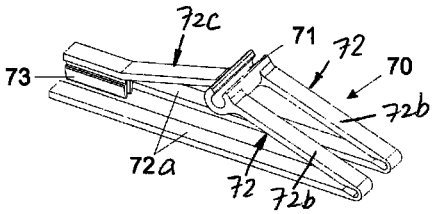
Figure 5N:
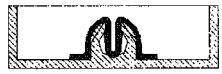
Figure 5O:
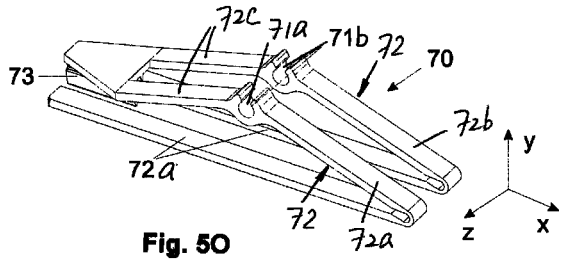
Figure 5P:
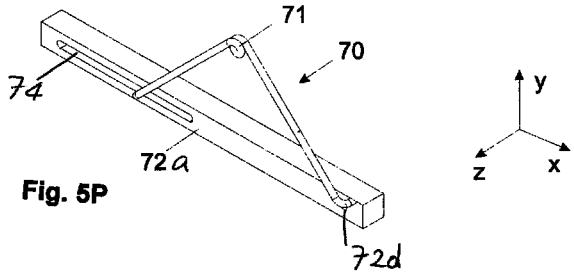
Figure 6D:
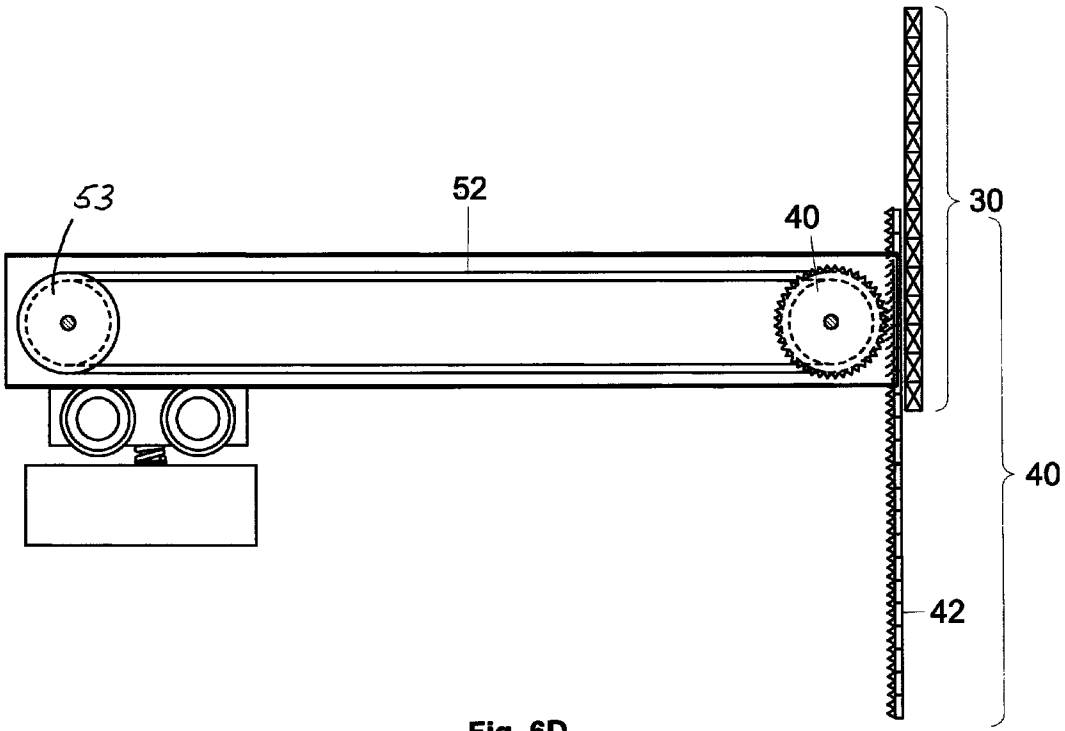
Figures 6E, 6F:
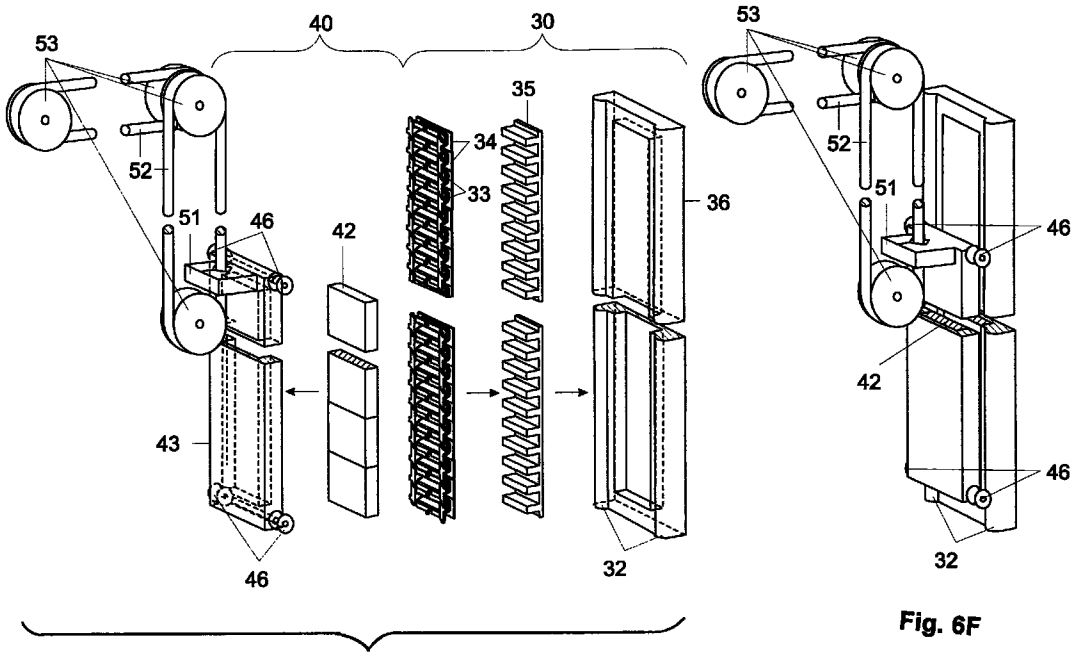
Figure 7A:
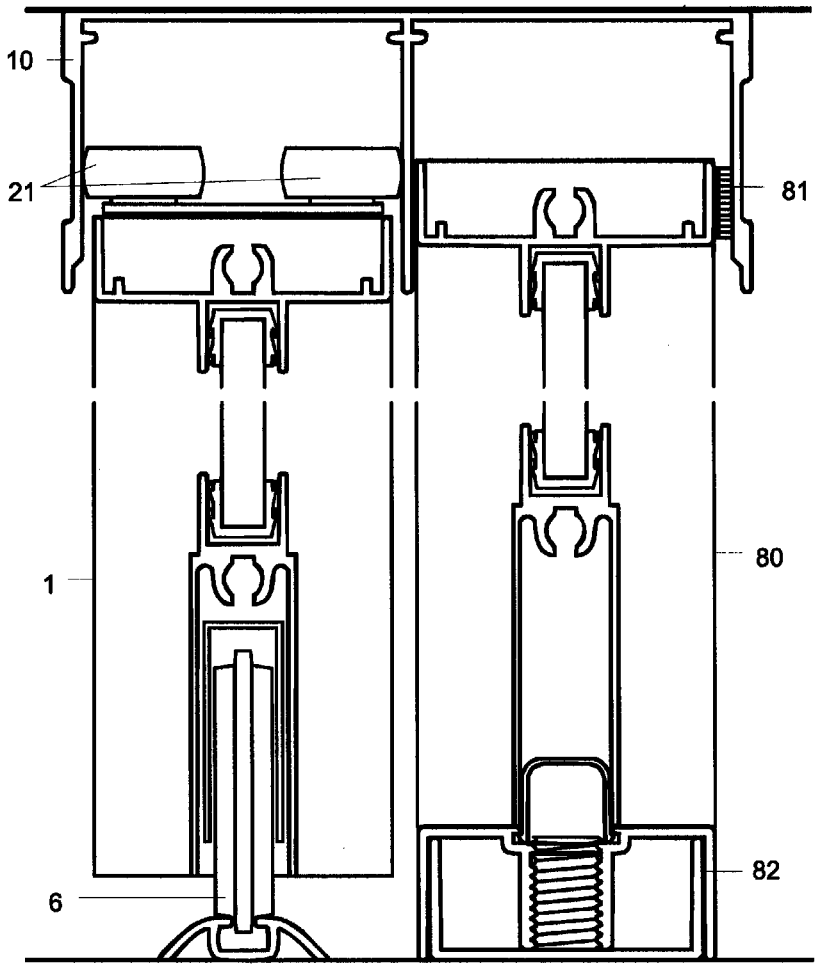
Figure 7B:
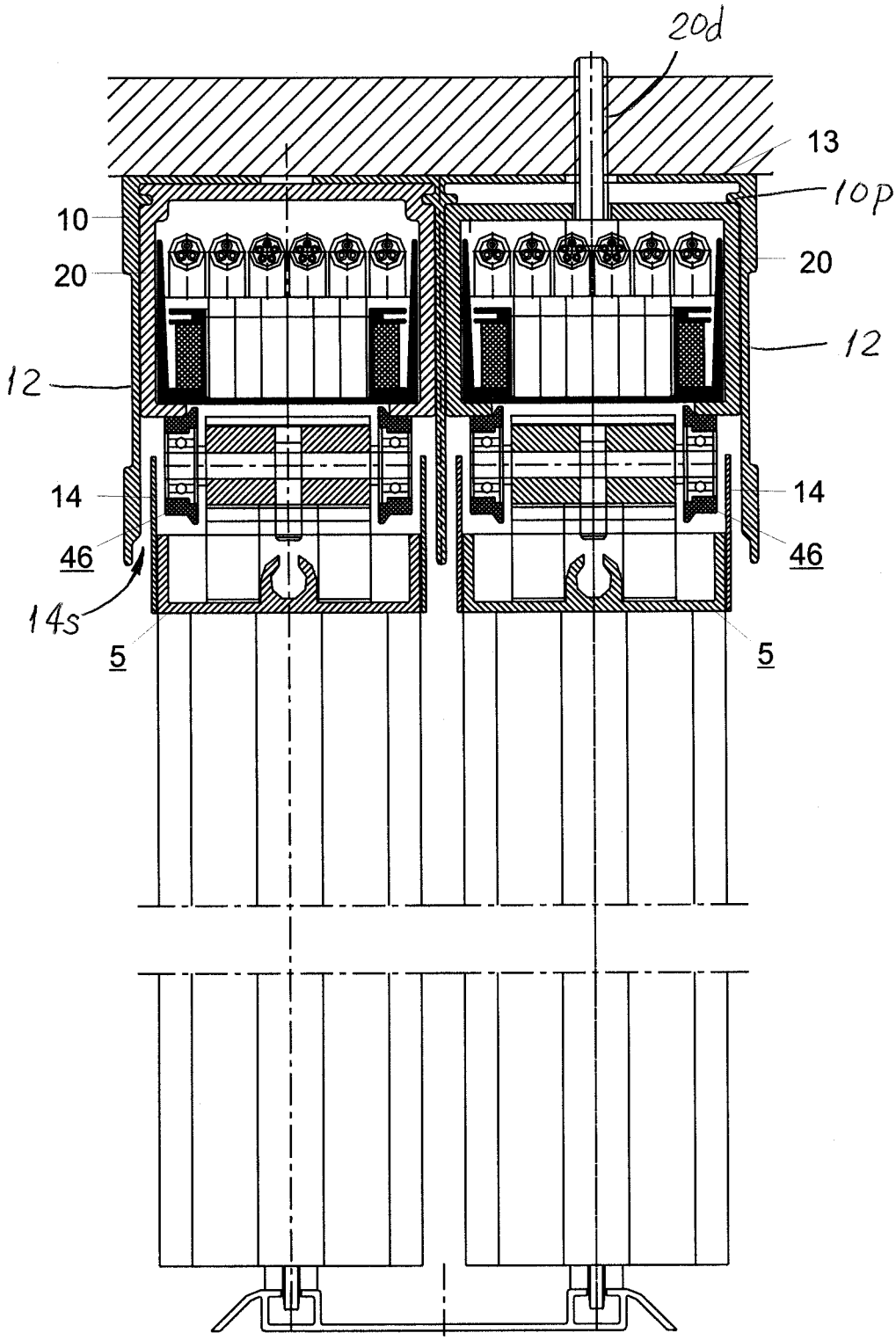
Figure 7C:
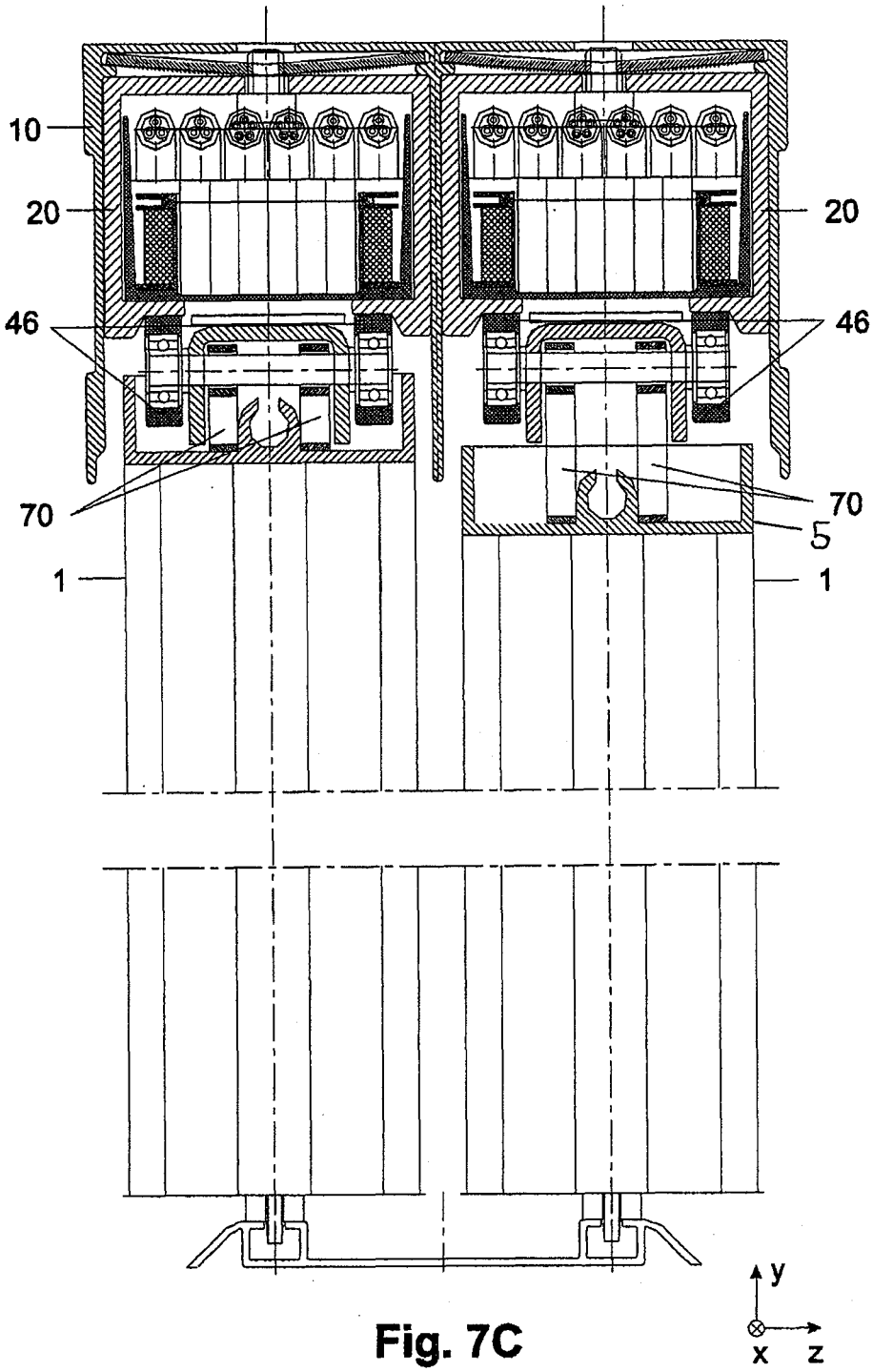

Further features and advantages of the invention will become apparent from the following description of preferred embodiments, in which:

FIG. 1 is a partial prospective view of a sliding door suspension according to a first embodiment of the invention, FIGS. 2A and 2B show floor rail supports for a sliding door leaf in various executions, FIGS. 3A to 3J shown linear drive systems, based on traction means, for the sliding door suspension of FIG. 1, FIGS. 4A to 4I show spindle drives for the sliding door suspension of FIG. 1, FIGS. 5A to 5P show linear motors for the sliding door suspension of FIG. 1, FIGS. 6A to 6F show a sliding door suspension according to a second embodiment of the invention, and FIGS. 7A to 7C show sliding door suspensions according to further embodiments of the invention mounted in position during normal use.

As shown in FIG. 1, a suspension according to a first embodiment of the invention has a sliding door leaf 1, which is supported and guided in a guiding profile 10. In the example illustrated in FIG. 1, the sliding door leaf 1 is formed by means of a glass pane surrounded by a frame 4. The frame 4 has an upper frame part 5, which may be configured integrally with the rest of the frame 4. At a lower border, the sliding door leaf 1 is guided in a floor rail 3 by means of rollers 6 to prevent the sliding door leaf 1 from breaking away in the ±z-coordinate direction in FIG. 1. In addition the roller 6 may be provided to receive the weight of the sliding door leaf 1 such that upper guiding rollers 21, provided in the guiding profile 10, are relieved.

As an alternative, the lower rollers 6 are omitted such that the sliding door leaf 1 is received in the guiding profile 10 such as to freely float.

At a top side, i.e., at a side facing the guiding profile 10, when seen in the y-coordinate direction, the upper frame part 5 has a roller mounting 8 preferably at both ends of the upper frame part 5, FIG. 1 revealing only the roller mounting 8 facing the viewer. At each roller mounting 8, parallel to an x-z-plane of FIG. 1, when seen in the x-coordinate direction, on the right and the left hand side, respectively one guiding roller 16 is disposed freely rotatably in relation to the respective roller mounting 8. The guiding rollers 16 run each on an associated guiding rail 11 of the guiding profile 10.

In the example illustrated in FIG. 1, the guiding rails 11 have a crown-shaped running surface. The guiding rollers 16 have a running surface configured complementarily to the running rail. This type of running surfaces prevents the guiding rollers 16 from breaking away in the ±z-coordinate direction.

Above the guiding rollers 16, a driving profile 20 is fitted or inserted into the guiding profile 10. The driving profile 20 is intended to receive or to support parts of a linear drive system, which is not visible in FIG. 1.

In relation to the sliding door leaf 1, the rollers 6 are preferably supported in a resilient manner. This means the rotating axles of the rollers 6 are preferably not stationarily accommodated in the sliding door leaf 1 or attached to the latter. Preferably, the rotating axles of the rollers 6, as shown in FIG. 2A, are each accommodated in or attached to a free end 27*a* of respectively one hinge spring 27. The respective other end 27*b* of the respective hinge spring 27 is attached to or accommodated in a recess 4*a*, which is configured in the sliding door leaf 1, or in the frame 4 thereof. A central section 27*c* of the respective hinge spring 27 is propped up at a surface of the sliding door leaf 1 facing the floor rail 3. One side of the recess 4*a*, against which the central section 27*c* is abutting, preferably has a resiliently supported projection 4*b*. When installing the hinge spring 27, with the free end 27*a* at which the roller 6 is not mounted, the hinge spring 27 is inserted into a bearing journal 27*d* located in the recess 4*a* which is indicated in FIG. 2A. Thereupon, the central section 27*c* is pivoted into the recess 4*a* and thereby pushes the projection 4*b* away temporarily. If the central section 27*c* is guided past the projection 4*b*, the projection 4*b*, on account of the resilient support thereof, is moved back into its initial position, such that the projection 4*b* comes to rest below the central section 27*c*. The projection 4*b* thereby effectively prevents the central section 27*c* from exiting the recess 4*a* independently.

As an alternative, the suspension, as illustrated by way of example in FIG. 2B, can be carried out by means of a helical spring 27. In the present case, the frame 4 has a reception 4*a* for a holding part 24 at an underside of the frame 4. The reception 4*a* has a holding part reception section 4*ah* and a spring reception section 4*as*. Preferably on two opposite interior walls of the reception 4*a*, the holding part reception section 4*ah* has respectively one latching projection 4*b*. At corresponding surfaces of the holding part 24, the holding part 24 has respectively one recess 24*a* in the shape of a groove, which, however, is configured not to be continuous. The grooves 24*a* start at a border of a lower surface 24*b* of the holding part 24, respectively extend in the direction of the sliding door leaf 1 and end shortly below a border of an upper surface 24*u* of the holding part 24. The lower and the upper surfaces 24*b*, 24*u* extend horizontally, i.e., parallel to the x-z-plane in FIG. 2B. The upper surface 24*u* forms a stop for the corresponding latching projection 4*b*, such that the holding part 24 can move up and down along the latching projections 4*b* within the recess 4*a*; however, can not fall out. At the upper surface 24*u*, the holding part 24 has a projection 24*p*, which extends in the direction of the sliding door leaf 1, i.e., in the y-coordinate direction in FIG. 2B. The helical spring 27 is fitted onto the projection 24*p* of the holding part 24.

FIGS. 3A and 3B show a variant of a linear drive system embodied as a flexible drive 50 in the shape of a traction rope drive, which is integral with the driving profile 20. In FIG. 3A, the driving profile 20 is illustrated in a section along line I-I in FIG. 1. In FIG. 3B, the same driving profile 20 is illustrated in a section along a line II-II in FIG. 3A.

A drive motor 54 is dimensioned such that, when seen in the ±z-coordinate direction, it is completely received in the driving profile 20. A motor mounting 23 is placed in the driving profile 20, in which mounting the drive motor 54 is received torque-proof with regard to the driving profile 20.

The motor mounting 23 and the drive motor 54 are configured such that neither the motor mounting 23 nor the drive motor 54 is able to rotate about an x-coordinate axis in FIG. 3A. This is preferably achieved in that the motor mounting 23, in contact areas with the interior surfaces of the driving profile 20, is configured complementarily to them. At these contact areas, the motor mounting 23 is in a positive and/or non-positive engagement with interior surfaces of the driving profile 20. The motor mounting 23 has a space 23*m* for receiving the drive motor 54. In contact areas with the drive motor 54, this reception space 23*m* is configured complementarily to an exterior contour of the drive motor 54 positioned in these same contact areas. In the example illustrated in FIG. 3A, the motor mounting 23 is configured as a two-part piece and, seen in the ±x-coordinate direction, has rectangularly shaped cavities 23*r* in a transverse cross-section shown in FIG. 3A and on the left and right hand side, into which cavities 23*r* the drive motor 54 is inserted with its complementary configured projections 54*r*. If a cohesive friction between motor mounting 23 and drive motor 54 is not sufficient, the drive motor 54 can be additionally secured, respectively fixed in the motor mounting 23, for example by means of screws.

A transmission element in the shape of a cylindrical gear 57 is disposed torque-proof at a free end of an output shaft 54*s* of the drive motor 54. The cylindrical gear 57 is operatively connected to a crown wheel 58, which itself is torque-proof connected to a first deflection pulley 53 or, as is shown in FIG. 3B, is integrally configured with the first deflection pulley 53. Each deflection pulley 53 has a circumferentially extending groove 53*g*, into which a traction means 52, formed as a rope, is placed and is guided therein. A driver 51 is attached to a lower section of the rope 52, which driver 51 in turn is attached to a not-illustrated sliding door leaf 1 or is integrally configured with the latter or with an upper frame part 5 of the sliding door leaf 1.

A second deflection pulley 53', around which the rope 52 is likewise guided, is freely rotatably disposed at an end of the driving profile 20 facing away from the drive motor 54, such as to form a revolving rope drive. The rotating axles 56, 56' of the deflection pulleys 53, 53' are preferably supported at opposite sidewall sections 22 of the driving profile 20 and are supported freely rotatably.

As all parts of the linear drive system are stationarily mounted at or in the driving profile 20, the result is a drive module which can be easily placed, respectively inserted into the guiding profile 10 of the above described sliding door suspension, allowing for a simple installation, respectively for retrofitting of a so far manually operated sliding door, and of a sliding door leaf 1 which is already suspended, respectively guided by means of a guiding profile 10.

If the drive motor 54 has a larger dimension than a reception space of the driving profile 20, it is intended to mount the drive motor 54 stationarily at the right end of the driving profile 20, as is shown in FIG. 3B.

According to an embodiment illustrated in FIG. 3C, the motor mounting 23 has an insert portion 23*a* and a holding portion 23*b* for this purpose. The insert portion 23*a* serves to place, or to insert the motor mounting 23 into the driving profile 20. Advantageously, the insert portion 23*a* is configured such as to completely fill the reception space of the driving profile 20 in the area receiving the insert portion 23*a*. This means the motor mounting 23 is held by interior surfaces of the driving profile 20, which are in contact with the insert portion 23*a*. Fixing the insert portion 23*a* within the driving profile 20 can be realized by means of clamping, by means of screwing, by means of snap connection(s) or any other possible fixing. An end of the insert portion 23*a*, facing away from the driving profile 20, is adjoined by the holding portion 23*b*, which serves as a reception for the drive motor 54. Preferably, the drive motor 54 has a non-circular exterior contour (e.g., having projections 54*r*), whereas the holding portion 23*b* preferably has an interior contour, which is shaped complementarily to this exterior contour of the drive motor 54. Upon installing, the drive motor 54 reaches a positive engagement with the holding portion 23*b* of the motor mounting 23, such that the drive motor 54 is disposed torque-proof with regard to the holding portion 23*b*.

The insert portion 23*a* has a through-opening 23*t* serving for a reception and passage of the output shaft 54*s* of the drive motor 54. A freely rotatable bushing, which is received in the through-opening for example supported by ball bearings and freely rotatably, is preferably disposed inside the through-opening 23*t*. As an alternative, the bushing itself can serve as a pivot bearing for the output shaft 54*s* of the drive motor 54. At an end of the insert portion 23*a* facing the driving profile 20, the output shaft 54*s* protrudes from the former. The above described cylindrical gear 57 is torque-proof disposed at this protruding end 54*p* of the output shaft 54*s*.

In order to prevent the drive motor 54 from falling out of the holding portion 23*b*, the drive motor 54 is held by means of clamping within the reception space 23*m* of the holding portion 23*b*.

As an alternative or in addition, the drive motor 54 can be secured within the holding portion 23*b* by means of snap connection(s). For this purpose, suitably disposed latching projections, respectively latching receptions are to be provided at an exterior surface of the drive motor 54 and at corresponding reception surfaces of the holding portion 23*b*.

Again, as an alternative or in addition, a motor fixing can be provided, which is formed by means of a cover 23*c*, which, once the drive motor 54 has been installed into the holding portion 23*b*, is placed onto the end of the holding portion 23*b* facing away from the driving profile 20. Preferably, at the end, facing away from the driving profile 20, the holding portion 23*b* has threaded bores 23*h*. At corresponding locations, the cover 23*c* has through-openings 23*f*. Attachment screws 23*e*, passing through the through-openings 23*f*, are screwed into a respective threaded bore 23*h* of the holding portion 23*b*. As an alternative or in addition, on the other hand, the cover 23*c* can be fastened by means of snap connection(s) at the holding portion 23*b*.

The motor mounting 23 is preferably configured such that it will at least not protrude beyond an upper exterior face of the horizontal wall section 13 of the guiding profile 10, once the motor mounting 23 is installed in the driving profile 20 and once the driving profile 20 is installed into the guiding profile 10. It is thereby possible to mount the guiding profile 10 including the linear drive system, for example, at a ceiling (see, FIGS. 7B and 7C).

If the drive motor 54 has external dimensions, which will not allow to mount the above described cylindrical gear 57 torque-proof onto the output shaft 54*s* of the drive motor 54 and to couple it operatively to the crown wheel 58, a disposition according to FIG. 3D is provided. In this case, a transmission is preferably placed within the holding portion 23*b*, which bridges an offset of an axis of rotation of the cylindrical gear 57 in relation to an axis of rotation of the output shaft 54*s* of the drive motor 54.

The through-opening 23*t* of the insert portion 23*a* communicates with an opening 23*t'* in the holding portion 23*b* at the end facing the insert portion 23*a* up to a pre-determined extension measure. This means the holding portion 23*b* has an axle reception 23*t'* with a cross-sectional shape, which essentially corresponds to a cross-sectional shape of the through-opening 23*t* of the insert portion 23*a*. The above described cylindrical gear 57 is disposed torque-proof on one end of a drive shaft 54*d*. The drive shaft 54*d* extends from the cylindrical gear 57 passing through the insert portion 23*a* into the axle reception 23*t'* of the holding portion 23*b*. At the end of the drive shaft 54*d*, located within the holding portion 23*b*, a transmission element, for example in the shape of another cylindrical gear 57', is disposed torque-proof. Another transmission element, again preferably in the shape of a cylindrical gear 57", is in engagement with the one transmission element 57'. On a side facing the insert portion 23*a*, the other cylindrical gear 57" is disposed torque-proof on an axle which in turn is freely rotatably supported in a second axle reception formed within the holding portion 23*b*. On an opposite side, namely facing away from the insert portion 23*a*, the other transmission element 57" has a recess 57*r*" with a non-circular interior contour. At the free end, the output shaft 54*s* of the drive motor 54 has an exterior contour, which essentially is configured complementarily to the interior contour of the recess 57*r*" of the other transmission element 57". When installing the drive motor 54, the output shaft 54*s* of the drive motor 54 reaches positive rotational engagement with the other transmission element 57". By means of the transmission in the holding portion 23*b*, the drive motor 54 is thereby operatively connected to the above described cylindrical gear 57.

According to an advantageous further development of the invention, the other transmission element 57", on both sides, is torque-proof disposed on an axle 57*a*", hence has no recess with a non-circular interior contour. The axle 57*a*", on both sides of the other transmission element 57", is received and freely rotatably supported within the second axle reception of the holding portion 23*b*. At an end facing the drive motor 54, the axle 57*a*" has now a recess analogously to the recess 57*r*" described above for the other transmission element 57", which recess serves for the reception of the free end of the output shaft 54*s* of the drive motor 54. This further development has the advantage that the axle 57*a*" is supported not only on one side, but on both sides of the other transmission element 57" in two locations, providing constructional advantages.

According to an advantageous further development of the invention, the motor mounting 23 is configured such that the holding portion 23*b* and possibly the cover 23*c* have an exterior contour, which corresponds to an exterior contour of the guiding profile 10 such that a user gets the impression that the holding portion 23*b* and possibly the cover 23*c*, in the installed condition, seem to be a part of the guiding profile 10 and thus appear to be a continuation thereof.

Again, according to another advantageous further development of the invention, the motor mounting 23 is configured such that the holding portion 23*b* and possibly the cover 23*c* have an exterior contour which corresponds to an exterior contour of the driving profile 20. Therefore, the holding portion 23*b* can be considered as a continuation of the driving profile 20 and, like the driving profile 20, can be reliably and invisibly for a user accommodated within the guiding profile 10.

In case of a multi-leaf sliding door, two or more driving modules can be placed into the guiding profile(s) 10. For the purpose of a possibly required synchronization, they may be additionally interconnected or connected to a centralized control circuit.

FIGS. 3E to 3H shown a linear drive system configured by means of a belt drive 50. The disposition is similar to the one of FIGS. 3A and 3B. In this example a bevel gear 55 is utilized instead of a cylindrical gear-crown wheel transmission 55. In addition, each rotating axle 56 (and possibly a bevelled wheel 59 torque-proof disposed with regard to the right deflection pulley 53) is not received at both ends in sidewall sections 22 of the driving profile 20, but is supported in a respectively associated holding member 24. The holding members 24 are preferably stationarily mounted at an upper horizontal wall section 25 of the driving profile 20 or are integrally configured with the latter. As can be seen in particular in FIGS. 3E to 3G, seen in ±z-coordinate direction, each holding member 24 has a cross-sectional shape of a U open in −y-coordinate direction. One respective deflection pulley 53 is freely rotatably disposed in an inner space of the U. The driver 51, as illustrated in more detail on in FIG. 3H, is provided with a latching device 51*a*, 51*b*, such as to make screws redundant, increasing mounting friendliness and simplifying a possible exchange.

In the above described linear drive systems, a tensioning device 52*t* for the traction means 52 is preferably provided, which, advantageously, automatically tensions itself to a predetermined extent.

As an alternative, the linear drive system may be likewise configured by means of a chain drive 50, as illustrated in FIGS. 3I and 3J. In the example illustrated here, the drive motor 54 is fixed in the motor mounting 23 by means of screws 23*s*.

The described cylindrical gear-crown wheel and bevel gears 55 are interchangeable. In addition, they may be replaced by any other possible transmission, as long as the function is maintained.

FIGS. 4A to 4I show linear drive systems in the shape of a spindle drive 60 respectively, in which FIGS. 4B, 4E, and 4H are each a sectional view along line I-I of FIG. 1 is illustrated, and FIGS. 4A, 4D, and 4G are respectively sectional views taken along respective lines V-V, VI-VI, and VII-VII illustrated in respectively FIGS. 4B, 4E, and 4H.

A drive motor 64 is mounted in the driving profile 20 respectively in a motor mounting 23, analogously to the above described linear drive systems. An output shaft 64*s* of the drive motor 64 is operatively coupled to a threaded spindle 62. The threaded spindle 62 is freely rotatably supported in a spindle bearing 63. According to an embodiment of the invention illustrated in FIGS. 4A to 4C, the spindle bearing 63 has two bearing parts 63', 63", which are mounted at an interior side of the upper wall section 25, and extend in the direction of the threaded spindle 62, i.e., in −y-coordinate direction in FIG. 4A. The bearing parts 63', 63" have one through-opening 63*t*, 63*t'* each for the reception of the threaded spindle 62. The through-openings 63*t*, 63*t'* may have a smooth interior surface.

As an alternative, the through-openings 63*t*, 63*t'* are provided with a female thread into which the threaded spindle 62 is screwed.

As an alternative, as shown in FIG. 4C, a bearing bushing 63*b*, 63*b'* is fitted into the through-opening 63*t*, 63*t'*, which bushing 63*b*, 63*b'* has a female thread on the inside into which the threaded spindle 62 is screwed. It is thereby possible to manufacture the respective bearing part 63', 63" from an inexpensive material and to just produce the bearing bushing 63*b*, 63*b'* from a material which is suitable for bearing the threaded spindle 62. Preferably, the bearing bushing 63*b*, 63*b'* is freely rotatably disposed within the through-opening 63*t*, 63*t'*.

As shown in FIG. 4A, the bearing parts can be attached to the horizontal wall section 25 for example by means of screws or they can be integrally formed with the driving profile 20.

A driver 61 of a non-illustrated sliding door leaf 1 likewise has a through-opening 61*t* for the reception of the threaded spindle 62 and has a female thread on the inside, into which the threaded spindle 62 is screwed. The driver 61 may have an above described bearing bushing 61*b* with the restriction that the bearing bushing 61*b* is disposed torque-proof in relation to the driver 61. In addition, at an end facing away from the sliding door leaf 1, the driver 61 has a roller 65, the axis of rotation thereof extending in the ±z-coordinate direction in FIG. 4A. The roller 65 is freely rotatably disposed in the driver 61 such that the roller 65 rolls on an interior surface of the upper wall section 25. This circumstance serves to prevent the threaded spindle 62 from bending in y-coordinate direction in FIG. 4A, in the area of the driver 61.

According to another embodiment of the invention illustrated in FIGS. 4D to 4F, the spindle bearing 63 is configured by means of a bearing part 63' having the shape of a bracket. The bearing part 63' has two threaded spindle reception portions 63*s* and one portion 63*h*, which interconnects the two reception portions 63*s* and is itself attached to the interior surface of the upper wall section 25 of the driving profile 20.

In order to achieve a higher stability, according to another variant shown in FIGS. 4G to 4I, it is intended that the reception portions 63*s* of the spindle bearing 63 also supported against the insides of the sidewall sections 22 of the driving profile 20 and are possibly screwed to them.

In FIGS. 5A and 5B, a linear motor drive is shown which is incorporated into the sliding door suspension of FIG. 1. A linear motor 2 has a stator 30 and a rotor 40. The stator 30 is formed by means of at least one stator module. As FIG. 5B shows, each stator module has a row of consecutively disposed coils 33, which are wired according to a predetermined control scheme. The coils 33 are preferably fitted onto, respectively mounted on associated coil forms 34. The coil forms 34 are preferably mounted onto a magnetizable keeper 35 and are preferably moulded with the latter to form a stator module.

The at least one stator module is preferably inserted into a reception profile, which is adapted to be inserted into the above described driving profile 20. This means, instead of the above described linear drive systems as complete modules, in this case, just the stator 30, as a component of the linear motor 2, is inserted into the driving profile 20. The reception profile is preferably configured such that, during insertion into the driving profile 20, the reception profile is locked in order to be reliably retained. As an alternative, latching connections, screw connections or any other attachment options are possible.

As an alternative, each stator module is directly inserted into the driving profile 20.

Preferably, the stator modules have a height $h_S$, which is inferior to a height $h_A$ of a reception space of the driving profile 20 for the stator 30. This means that a hollow space is provided above the stator 30. This hollow space is useful for example if, when seen in ±z-coordinate direction in FIG. 5B, stator modules of the stator 30 have a distance with regard to each other and if additional components, such as a smoke detector, are to be mounted in an intermediate space provided between the stator modules. Another application case would be a multi-leaf sliding door. In this case, several stators 30 are accommodated in the driving profile 20, which for example need to be differently controlled with regard to their drive direction. This implies that the stators 30 require at least separate control lines. By means of the above described hollow space, it is possible to have all lines of all the stators 30, respectively of the stator modules, and if required of additional components, exit the guiding profile 10 at a single location. It is thereby possible to provide a single port at a single location of the sliding door suspension. One cable duct can be used for all required lines, thus resulting in a considerably simplified cabling.

The ends of the sidewall sections 22, facing away from the horizontal wall section 25, are adjoined by projections 26, which are configured parallel to the horizontal wall section 25 and are facing each other. Upper surfaces of the projections 26 form bearing surfaces for the stator 30. The stator 30 is thus resting with its underside on these projections 26.

The rotor 40 associated to the linear motor 2 is formed by means of one or more rotor parts 41, as is shown in FIG. 5B, and is disposed between roller mountings 8 of a respective sliding door leaf 1 (see also FIG. 1). This means that each rotor 40 is disposed in an interspace formed respectively between two roller mountings 8.

In order to prevent the rotor 40 from sticking to the stator 30, the rotor members 41 are provided with rotor rollers 46. Advantageously, the rotor rollers 46 are disposed such as to roll respectively on an underside of the above described projections 26 of the driving profile 20. Thus, the projections 26 have several functions. On the one side they serve to support the stator 30 to the top of the linear motor 2 and the rotor 40 to the bottom of the linear motor 2. On the other side, in conjunction with the rotor rollers 46, the projections 26 guarantee a predetermined minimum distance between stator 30 and rotor 40. Thereby, in terms of an interaction between the stator 30 and the rotor 40, a desired operation of the linear motor 2 is made possible. Furthermore, the rotor 40 is guided along the projections 26 and thus along a travel path to be respected. For this purpose, the rotor rollers 46 have preferably at least one wheel flange.

Overall, the achieved result is a very compact and space-saving structure of the linear motor 2, as well as a simple incorporation into the above described guiding profile 10 of the sliding door suspension of FIG. 1.

According to the embodiment of the invention illustrated in FIGS. 5A and 5B, an operative connection in the shape of at least one driver, configured as a connecting pin 45, is provided between the rotor 40 and the sliding door leaf 1. The connecting pin 45 is stationarily mounted preferably in a body 43 of the rotor 40 or is inserted into the latter, for example by means of screwing. The connecting pin 45 protrudes beyond the body 43 into the direction of the sliding door leaf 1 to an extent that the free end of the connecting pin 45 is disposed below an upper end portion of a mounting portion 47 of the sliding door leaf 1, which mounting portion 47 serves to receive the connecting pin 45. The mounting portion 47 has a reception 47*a* into which the connecting pin 45 engages and thus entrains the sliding door leaf 1 during a movement of the rotor 40. In addition, the reception 47*a* has a depth, which is deeper than a maximum possible introduction depth of the connecting pin 45 into the reception 47*a*. Thereby the sliding door leaf 1 can move in the ±z-coordinate direction up to a predetermined measure, without having a particular effect on the connecting pin 45.

In contact surfaces with the connecting pin 45, the reception 47*a* is preferably covered with an elastic plastic material or is formed by means of this plastic material. Thereby, despite a constant contact between the connecting pin 45 and the reception, a certain play is possible between them without resulting in delays in the movements of the rotor 40 and the sliding door leaf 1, and therefore without resulting in a jerky or irregular movement of the sliding door leaf 1.

Preferably, the reception 47*a* is configured such that the sliding door leaf 1 can move to a predetermined extent in the ±z-coordinate direction with regard to the connecting pin 45. For this purpose, when seen in the ±y-coordinate direction in FIG. 5B, the reception 47*a* has an oblong hole-shaped cross-section extending preferably in the ±z-coordinate direction. A transmission of transversal movements of an upper portion of the sliding door leaf 1, i.e., movements in the ±y-coordinate direction in FIG. 5A, is at least weakened to a predetermined extent.

In FIGS. 5A and 5B, an upper frame part 5 of the sliding door leaf 1, not illustrated in detail, is shown as an example in respectively front and cross-sectional views. When seen in the direction of its longitudinal extension, the upper frame part 5 has a mounting portion 47 in the center, which in cross-section preferably has the shape of an O. At two locations respectively one spring element 70 is attached with one end to the in this case one body 43. The spring elements 70 also extend in the direction of the sliding door leaf 1 and are supported at an upper surface of the upper frame part 5.

Preferably, already in a resting state of the sliding door leaf 1, the spring elements 70 are pre-tensioned. Thus, on account of the spring elements 70, the rotor 40 is pressed in the direction of the stator 30. In conjunction with the rotor rollers 46 it is thus guaranteed that the rotor 40 has an almost constant distance to the stator 30, which is required for the operation of the linear motor 2. Furthermore, the spring elements 70 achieve that possible unevenness along the travel path of the sliding door leaf 1 and/or other movements of the sliding door leaf 1, as a desired, or "ideal" travel motion, are not transferred to the rotor 40, at least not to a considerable extent. Despite the fact that the sliding door leaf 1 is entrained by the rotor 40, the furthest going uncoupling of rotor 40 and sliding door leaf 1 is realized with regard to unwanted movements of the sliding door leaf 1. In addition, an attraction force is possible between the rotor 40 and the stator 30, which force is smaller than the weight of the rotor 40.

As an alternative or in addition thereto, it is intended to support the connecting pin 45 in the body 43 pivotably to a predetermined extent, at least about one ±x-coordinate axis in FIG. 5B. Thereby a simple possibility is created to prevent the transmission of at least unwanted transversal movements of the sliding door leaf 1 onto the rotor 40 completely or to a high degree. If the connecting pin 45, as shown in FIGS. 5C and 5D, is additionally supported pivotably about the ±z-coordinate axis, jerky movements of the sliding door leaf 1 in the ±x-coordinate direction are at least dampened. Furthermore, during the state of acceleration, the rotor 40 entrains the sliding door leaf 1 only after a maximum possible pivoting of the connecting pin 45. During deceleration, the rotor 40 is already slowed down, prior to slowing down the sliding door leaf 1.

The mounting portion 47 is preferably manufactured from an elastic material. The spring elements 70 are abutting the mounting portion 47 laterally such that they clamp the mounting portion 47 to a predetermined extent and are thus able to relieve the connecting pin 45.

According to an embodiment of the invention shown in FIG. 5D, preferably at the end received in the body 43, the connecting pin 45 has the shape of a sphere, the exterior diameter thereof, seen parallel to the x-z-plane, being larger than the dimensions of at least a part of the connecting pin 45, which part is likewise received in the body 43. This allows for pivoting the connecting pin 45 in any direction of the x-z-plane.

In the linear drive systems 50, based on a traction means 52, usually rigidly formed drivers are intended for the operative connection of the traction means 52 to the respective sliding door leaf 1.

Basically, such rigid drivers are also suitable for the spindle drive 60 and for the linear motor 2. With the linear motor 2, a respective driver 51 is stationarily mounted, preferably at an underside of the rotor 40 or at a carriage 28.

In FIGS. 5E to 5H, an operative connection between the rotor 40 and the sliding door leaf 1 is shown according to another embodiment of the invention. Helical springs are used instead of leaf springs or hinge springs as the spring elements 70. The body 43 has receptions 43*r* for the helical springs 70, which receptions 43*r* are open to the bottom. Preferably one pin-shaped projection 43*p*, extending in the direction of the sliding door leaf 1, is located within each reception 43*r*. A respective helical spring 70 is fitted into the reception 43*r* and, at an end facing the body 43, fitted onto a respective projection 43*p*. At the other end, the helical spring 70 is fitted onto a connecting element 44, shown in the right top of FIG. 5F. The connecting element 44 is configured such as to be inserted into the respective mounting portion 47 preferably by means of a clamping effect. For this purpose, the mounting portion 47 is configured to be open towards the rotor 40 and to have a reception 47*a* which expands to the bottom. The connecting element 44 has an exterior contour which is essentially complementary to an interior contour of the reception 47*a*, the exterior dimensions thereof being preferably slightly larger than the corresponding interior dimensions of the reception 47*a*. During insertion, the mounting portion 47 is spread open and the connecting element 44 is pressed into the reception. At the end facing the helical spring 70, the connecting element 44 has a spring abutment, against which the helical spring 70 bears with its end facing away from the body 43. In addition, the connecting element 44 has a pin-shaped projection analogously to the projection 43*p* in the reception 43*r* in the body 43.

A separate connecting element 44 may be provided for each helical spring 70, as shown in the center of FIG. 5G. As an alternative, all connecting elements 44 are configured as one piece as shown in FIG. 5D. If the thus formed entire connecting element 44 has a length equivalent to a length of a reception space for the connecting element 44, the clamping force of the entire connecting element 44 may be smaller than in the previously described variant. Thus, at both ends, the connecting element 44 abuts at stop faces in a recess 5*a* of the upper frame member 5, in the case of a solid leaf sliding door leaf 1, and thus reliably entrains the sliding door leaf 1.

In both variants, the spring element 70 additionally assumes a driver function with regard to the sliding door leaf 1.

If no mounting portion 47 is provided, according to a third embodiment of the invention shown in FIGS. 5I to 5K, it is intended to use the reception space itself of the upper frame profile 5, respectively of the solid leaf sliding door leaf 1.

In FIG. 5L, a spring element 70 is shown according to another embodiment of the invention. In a central section, this spring element 70 has a reception 71 for a rotating axle. The respective rotating axle is disposed in a respective body 43 of a rotor 40 of a linear motor 2 and extends in ±z-coordinate direction. The axle reception 71 allows for simple fitting onto a non-illustrated axle-shaped part in the body 43 of a rotor 40 of a linear motor 2. During this fitting process, the axle reception reaches engagement with the respective axle-shaped part and prevents the spring element 70 from falling off the axle-shaped part.

Furthermore, the spring element 70 is made from an elastically deformable material. Similar to the above described embodiments, free ends 70*a*, 70*b* of the spring element 70 are supported at an upper surface of a sliding door leaf 1 or of an upper frame part 5. Preferably, one end 70*a* is configured to be flatter than the respective other end 70*b* and is fitted into a reception formed at the upper surface of the sliding door leaf 1 or of the frame part 5.

An alternative spring element 70, according to yet another embodiment of the invention shown in FIGS. 5M and 5N, has two legs 72 having a seating portion 72*a*, on which the spring element 70 is supported. Respectively in the same direction, a spring portion 72*b*, which is formed by means of a bent leg portion, adjoins each seating portion 72*a*. These leg portions 72*b* lead to a common axle reception 71. A side of the axle reception 71, facing away from the leg portions 72*b*, is adjoined by an insertion portion 73, which is configured such as to be inserted into an above described mounting portion 47 by means of latching and preferably to be arrested therein by means of clamping.

According to an embodiment of the invention shown in FIG. 5O, a spring element 70 is distinguished from the previous embodiment in that the leg portions 72*b* do not lead to an axle reception 71. Instead they have respectively their own axle reception 71*a*, 71*b*. When seen in ±z-coordinate direction, the axle receptions 71*a*, 71*b* are disposed to be aligned. The respective axle receptions 71*a*, 71*b* is adjoined by respectively another leg portion 72*c*. These other leg portions 72*c* lead to the above described insertion portion 73.

Yet another embodiment of the spring element 70 is shown in FIG. 5P. The seating portion 72*a* is formed by means of an essentially block-shaped part. An opening 72*d* is formed in the seating portion 72*a* for an irrotational reception of one end of a hinge spring 70. The other end of the hinge spring 70 is received in a guided manner in an oblong hole 74, which is formed in the block-shaped part and essentially extends in the direction of its longitudinal extension. In the center, the hinge spring 70 preferably forms a through-opening 71, again for the reception of a rotating axle. As an alternative, the hinge spring, with this portion, abuts at the body 43 of a respective rotor 40.

FIG. 6A shows a sliding door suspension in the assembled condition according to a second embodiment of the invention. In this example, it is a sliding door leaf 1 which has an upper border 1*s* extending at a slant. In the closed condition, the border 1*s* extending at a slant abuts at a wall 7 likewise extending at a slant, such as found for example with walk-in wall closets in an attic flat. The stop face extending at a slant for the sliding door leaf 1 is thus a ceiling extending at a slant. In this case, the sliding door leaf 1 is guided in a floor rail 3 by means of at least two rollers 6. Preferably, the rollers 6 carry at least partially the weight of the sliding door leaf 1.

In order to prevent the sliding door leaf 1 from tilting in ±z-coordinate direction in FIG. 6A, a connecting element 44, which may be likewise integrally formed with the sliding door leaf 1 and extends from the sliding door leaf 1 towards the open-position of the sliding door leaf 1, is mounted in the highest located corner at an upper termination of the sliding door leaf 1.

If an above described flexible drive 50 or spindle drive 60 is used, a driver 51 is coupled to the respective traction means 52.

If a linear motor 2 per se is to be utilized as a drive with the sliding door 1 according to FIG. 6A, one of the above described configurations can be used, in which the linear motor 2 extends along the travel path of the sliding door leaf 1. In this case, it is intended to provide a space for the linear motor 2 behind the sliding door leaf 1 in the closed position, seen in x-coordinate direction in FIG. 6A, which space has a depth which is larger or equivalent to a sum of a length of the rotor 40 and a length of the travel path of the sliding door leaf 1. This is conditioned by the fact that the rotor 40 is displaced along the travel path of the sliding door leaf 1 and, with an end facing the sliding door leaf 1, comes to rest at a border of the sliding door leaf 1 facing the rotor 40.

If the available space is not sufficient, an embodiment shown in FIG. 6A is possible. In this case, in the closed position of the sliding door leaf 1, the rotor 40 is disposed essentially parallel with regard to the extension of the upper border 1*s* of the sliding door leaf 1. Furthermore, a carriage 28 of the sliding door leaf 1 is guided and supported in at least one horizontally extending guiding rail of a right driving profile 20 in FIG. 6A. The rotor 40 is mounted at an end of the carriage 28 facing the sliding door leaf 1. In the closed position of the sliding door leaf 1, the rotor 40 is guided and supported in the direction of its longitudinal extension, for example by means of non-illustrated rotor rollers 46, at an above described left driving profile 20. The left driving profile 20 extends at a predetermined distance parallel to the border 1*s* extending at a slant of the sliding door leaf 1. During an opening procedure, the rotor 40 is moved to the right in FIG. 6A by means of a left stator module accommodated in the left driving profile 20. During this procedure, the rotor 40 leaves more and more an interaction range of the left stator module. At the same time, the rotor 40 gradually enters an interaction range of the right stator module, which is accommodated in the right driving profile 20.

In order for the rotor 40 to bridge the angle between the two driving profiles 20, the rotor 40 is configured to be flexible. According to an embodiment of the invention illustrated in FIGS. 6B and 6C, the rotor 40 is composed of individual rotor members 41. Each rotor member 41 comprises a body 43, on which a row of magnets 42 is stationarily mounted, for example by means of glueing. Each rotor member 41 has respectively one bearing bushing 43*b* at each end towards another respective adjacent rotor member 41. The bearing bushings 43*b* extend in a horizontal direction transversally with regard to a longitudinal extension of the rotor 40, i.e., in ±z-coordinate direction parallel to an x-z-plane in FIG. 6A. In addition, each bearing bushing 43*b* has a length, which preferably corresponds to one half of a maximum width of the respective rotor member 41. When seen in the direction of the longitudinal extension of the rotor 40 in the x-z-plane, each bearing bushing 43*b* is flush with one side of the associated rotor member 41.

It is preferably intended that the two bearing bushings 43*b* of one rotor member 41 are respectively flush with different sides of the associated rotor member 41. This means, the bearing bushings 43*b* are rotationally symmetrically disposed such that the respective rotor member 41, in one position and in another position, in which it has rotated about the y-coordinate axis about 180° in FIG. 6A, has the same appearance. This provides the advantage that, at both ends, the rotor members 41 can be connected to another rotor member of the same kind.

When assembling two directly adjacent rotor members 41, the bearing bushings 43*b* facing each other result in one entire bearing bushing 43*b* for an axle, the rotor rollers 46 being provided at the ends thereof. The rotor rollers 46 are preferably freely rotatably disposed on the associated axle. Therefore, the axle can be formed as an insert axle, which is stationarily insertable into a respective entire bearing bushing 43*b*.

As an alternative, the rotor rollers 46 are torque-proof disposed on the associated axle, and the axle is freely rotatably supported in the respective entire bearing bushing 43*b*.

In rotor members 41, which are disposed at the ends of the rotor 40, it is preferably intended that the bearing bushing 43*b* of the respective end rotor member 41 facing away from the other rotor members 41 extends over a total width of this terminal rotor member 41. Thus this bearing bushing 43*b* itself forms an entire bearing bushing 43*b*.

In order to prevent the rotor members 41 from sticking to one of the stator modules, respectively one arrangement of rotor rollers 46 is provided, preferably between each pair of directly adjacent rotor members 41, as shown in FIG. 6B.

As an alternative, the bearing bushings 43*b* may be configured such as to allow pivoting of directly adjacent rotor members 41 exclusively in −y-coordinate direction in FIG. 6B, i.e., towards the bottom. This can be achieved by means of rotor members 41 which are configured as shown on in FIG. 6C. The bearing bushings 43*b* do not have a round exterior cross-section, but they have instead essentially vertically flat executed exterior wallings, i.e., configured parallel with regard to the y-z-plane. The bearing bushings 43*b* abut with these wallings at opposite parallel configured wallings of the directly adjacent rotor member 41 facing them. This means that, if the magnetic force is sufficient, the respective stator module attracts the rotor members 41, which are situated within its interactive range, such that they are oriented parallel to the x-z-plane in FIG. 6B and therefore sticking is not at all possible or very unlikely. In this case, some of the rotor rollers 46 may be omitted, which reduces a roller friction resistance generated by the rotor rollers 46 on a respective guiding rail.

A carriage 28, disposed above the connecting element 44, is connected to the connecting element 44 by means of a not illustrated driver such that the carriage 28 entrains the sliding door leaf 1 upon movement.

If the weight of the sliding door leaf 1 is completely absorbed by the rollers 6, an arrangement of guiding rollers 21 is not required.

As an alternative, according to an embodiment of the invention shown in FIG. 6D, the rotor 40 of a linear motor 2 is provided with a toothing on a side facing the right deflection pulley 53. The rotor 40 thus has the shape of a unilateral toothed rack. The toothing is in engagement with a toothing of the right deflection pulley 53 or with a cylindrical gear 57, which is torque-proof disposed with regard to this deflection pulley 53.

The stator 30 of the linear motor 2 is interacting with a side of the rotor 40 opposite the toothing, on which side a row of magnets 42 of the rotor 40 is located. Thus, a translational up and down movement of the rotor 40 is transformed into a rotational movement of the right deflection pulley 53, which after that moves the traction means 52 with a not illustrated driver 51 which is mounted thereto.

If the space above the sliding door leaf 1 is not sufficient for the rotor 40, it may be intended, according to another disposition shown in FIG. 6D, to operatively connect the linear motor 2 to one of the deflection pulleys 53 via a transmission.

From a position of one respective deflection pulley 53 on, the stator 30 of the linear motor extends essentially downwards, i.e., vertically with regard to a direction of motion of the sliding door leaf 1. Coils 33 of the stator 30 are preferably fitted onto coil forms 34, which in turn may be fitted onto a magnetizable keeper 35. The thus formed stator module is preferably moulded and placed into a reception profile 36.

Furthermore, the reception profile 36 has preferably guiding rails 32 pointing towards the rotor 40. A body 43 of the rotor 40 has preferably a recess for a row of magnets 42. As an alternative, the body 43 has a plane surface facing the stator 30, on which surface the row of magnets 42, respectively are attached, for example by means of glueing. Rotor rollers 46 are freely rotatably disposed laterally of the body 43 such that they correspond to the guiding rails 32. Advantageously, the guiding rails 32 have crowned or convex shaped running surfaces, whereas the rotor rollers 46 have a running surface which is complementarily configured to the running surface of the respective guiding rail 32.

As an alternative, the running surfaces of the guiding rails 32 may be flat. In this case, the rotor rollers 46 are configured similar to wheels of rail vehicles. This means the rotor rollers 46 have a running surface with a flat cross-section and extending essentially parallel or slightly inclined with regard to the running surface of the respective guiding rail 32 and have at least one wheel flange, which can prevent the rotor 40 from derailing. At a side of the rotor 40 facing away from the stator 30, an additional driver 51 is mounted, which in turn is attached to a traction means 52 preferably by means of clamping and which is preferably configured similarly to one of the above described drivers 51. This traction means 52 is put around two additional deflection pulleys 53. The two additional deflection pulleys 53 are disposed so as to have the traction means 52, in the area of a travel path of the additional driver 51, extend parallel to a longitudinal extension of the rotor 40. An upper one of the two additional deflection pulleys 53 is either integrally configured with the right deflection pulley 53 of FIG. 3A or disposed torque-proof with regard to the latter.

The additional driver 51 is preferably disposed so as to be located close to the lower additional deflection pulley 53, in a position in which the non-illustrated sliding door leaf 1 is situated on the far left side in FIG. 6E. Furthermore, the additional driver 51 is preferably disposed at an upper end of the rotor 40 according to FIG. 6E. This allows for a vertical disposition of the linear motor 2, seen in ±x-coordinate direction, behind the sliding door leaf 1. This results in a very space-saving disposition.

The above described linear drive systems are respectively configured as a unit or as a drive module. They do not assume any function with regard to the factual carrying or guiding of a respective sliding door leaf 1. The sliding door leaf 1 is separately supported and guided along its travel path by means of a guiding profile 10, a floor rail 3 or by both. In this regard, the linear drive system is thus decoupled from the sliding door leaf 1.

FIG. 7A shows another sliding door system. In addition to a sliding door leaf 1, this system has an inactive leaf 80, which is screwed to a floor profile 82, and, in the direction of a guiding profile 10, has a laterally disposed sealing 81. In this example, the entire weight of the sliding door leaf 1 is absorbed by the rollers 6. The upper guiding rollers 21 simply serve for lateral guidance of the sliding door leaf 1 in this upper border area in the ±z-coordinate direction in FIG. 7A. The guiding profile 10 is a two-part piece and preferably has two identically formed interior spaces, one for the sliding door leaf 1 and one for the inactive leaf 80.

In such a guiding profile 10, the sliding door leaf 1 with a possible linear drive system and the inactive leaf 80 are interchangeable.

FIG. 7B shows the sliding door suspension of FIG. 7A equipped with two sliding door leaves 1, which are respectively provided with a linear motor. The upper frame parts 5 of the frames 4 respectively, seen in the ±x-coordinate direction of FIG. 7B, at least at one exterior side of one of the upper frame parts 5, have sealing lips 14, which are respectively disposed at one exterior side of the upper frame part 5. In conjunction with a respective directly adjacent disposed sidewall section 12 of the guiding profile 10 and exterior sides of the rotor rollers 46, respectively one sealing 14*s* is formed in the shape of a labyrinth seal.

A driving profile 20, disposed on the right hand side in FIG. 7B, has such a shape that the right-hand side driving profile 20 does not reach positive engagement with possible projections 10*p* in the guiding profile 10. To prevent the driving profile 20 from falling down, it is attached to a ceiling by means of dowels 20*d* for example and outlined attachment screws passing through the horizontal wall section 13 of the guiding profile 10. Thus, the attachment screws do not only secure the driving profile 20 but also the guiding profile 10 at the same time.

In FIG. 7C, a sliding door suspension is shown according to yet another embodiment of the invention. The sliding door leaf 1 illustrated on the right side has a lower height than the one illustrated on the left side. In order to compensate for the resulting height difference, the spring element 70 in the left sliding door leaf 1 has a larger height than the right one. At the same time, a dimension of respective exterior ends of two opposite disposed rotor rollers 46, seen in ±x-coordinate direction in FIG. 7C, is smaller than a width of the reception space 5*a* of the upper frame part 5. Thereby it is possible to partially receive the rotor rollers 46 in the reception space 5*a* of the upper frame part 5. This means that, despite the different sliding door leaves 1, the same linear drive system, here in the shape of linear motors 2, can be used at both sliding door leaves 1, the dimensions and positions of the motors 2 with regard to each other, respectively to the respective driving profile 20 or guiding profile 10 remain the same.

Attachment sections, which are disposed prestressed in the guiding profile 10, are provided for mounting the driving profiles 20.

Even, if the invention has been described in conjunction with a sliding door leaf 1, it is applicable to any other panel which is to be moved along a travel path, such as curved sliding doors, circular sliding doors, partitioning wall modules and the like.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A suspension for at least one movable panel, which is movable along a travel path, the suspension comprising:

a guiding profile configured to extend longitudinally along the travel path, the guiding profile having sidewall sections;

wherein the sidewall sections are configured to extend in a direction of the longitudinal extension of the guiding profile and parallel to a vertical extension of the movable panel; and wherein, at ends of the sidewall sections facing away from the movable panel, the sidewall sections are connected to each other by a horizontal wall section;

a linear drive system comprising a driver member comprises a body of a rotor member of a linear motor, which is operatively connected to the at least one movable panel;

a reception space formed in the guiding profile in a space between the horizontal wall sections and the driver member;

a driving profile placed in the reception space and comprising guiding rails and guiding rollers, the driving profile being mounted stationarily at the guiding profile and disposed in the guiding profile above a guide of the at least one movable panel, the linear drive system being stationarily mounted at or in the driving profile;

an end of the movable panel facing the guiding profile is received, guided, and supported in the guiding profile.

2. The suspension according to claim 1, wherein the linear drive system comprises a flexible drive having at least one traction means, which is guided revolving around two deflection pulleys, the driver member has an end facing away from the movable panel and is attached to the traction means, the linear motor is operatively connected to one of the two deflection pulleys or to a driving wheel of the flexible drive in a driving operative connection with the fraction means; and in a terminal area of the travel path, one of the two deflection pulleys is freely rotatably disposed at the driving profile.

3. The suspension according to claim 2, wherein the two deflection pulleys are supported on axles, and wherein the axles each have ends supported at sidewall sections of the driving profile.

4. The suspension according to claim 2, wherein the at least one traction means comprises one of a traction rope, a toothed belt, and a chain.

5. The suspension according to claim 2, wherein the movable panel is one of a sliding door leaf, a curved sliding door leaf, a revolving door leaf, and a folding door leaf, or a partitioning wall module.

6. The suspension according to claim 2, wherein the guiding profile has a plurality of reception spaces disposed side by side, transversally with regard to a direction of motion of the movable panel and substantially aligned parallel to each other.

7. The suspension according to claim 1, wherein the linear drive system comprises a spindle drive including the linear motor operatively connected to a threaded spindle, which is freely rotatably supported in spindle bearings and disposed to extend in a direction of the travel path, the spindle bearings being attached to or integrally configured with the driving profile, and the driver member, at an end facing away from the movable panel, has a threaded bushing portion, the threaded bushing portion having a threaded portion that is configured complementarily to the threaded spindle and is threadably inserted screwed onto the threaded spindle by the threaded portion.

8. The suspension according to claim 7, wherein the driver member has a roller, which is disposed to roll along the travel path of the movable panel on a side of the horizontal wall section facing the roller and to be supported on the same side.

9. The suspension according to claim 7, wherein the movable panel is one of a sliding door leaf, a curved sliding door leaf, a revolving door leaf, and a folding door leaf, or a partitioning wall module.

10. The suspension according to claim 7, wherein the guiding profile has a plurality of reception spaces disposed side by side, transversally with regard to a direction of motion of the movable panel and substantially aligned parallel to each other.

11. The suspension according to claim 1, wherein the linear drive system further comprises, a stator of the linear motor is placed into the driving profile and extends over a predetermined area of the travel path along the predetermined area, and the rotor, at a side facing away from the movable panel, has a row of magnets and is in interaction with the stator such that energizing the stator causes a movement of the rotor member, and the body, at a side facing the movable panel, is operatively connected to the movable panel.

12. The suspension according to claim 11, wherein the movable panel is one of a sliding door leaf, a curved sliding door leaf, a revolving door leaf, a folding door leaf, and a partitioning wall module.

13. The suspension according to claim 11, wherein the guiding profile has a plurality of reception spaces disposed side by side, transversally with regard to a direction of motion of the movable panel and substantially aligned parallel to each other.

14. The suspension according to claim 11, wherein the stator of the linear motor is placed in the driving profile and the rotor of the linear motor is disposed in an interspace, which is formed between respectively two roller mountings of the at least one movable panel.

15. The suspension according to claim 1, wherein the movable panel is one of a sliding door leaf, a curved sliding door leaf, a revolving door leaf, a folding door leaf, or a partitioning wall module.

16. The suspension according to claim 2, wherein the guiding profile has a plurality of reception spaces disposed side by side, transversally with regard to a direction of motion of the movable panel and substantially aligned parallel to each other.

* * * * *